United States Patent [19]

Dadbeh

[11] 4,027,878

[45] June 7, 1977

[54] BED LEVELING MECHANISM

[75] Inventor: Bemanali H. Dadbeh, Seal Beach, Calif.

[73] Assignee: Crown Recreation, Inc., Hollis, N.Y.

[22] Filed: Sept. 15, 1975

[21] Appl. No.: 613,186

[52] U.S. Cl. ..... 273/6; 108/144

[51] Int. Cl.[2] ..... A63D 15/00

[58] Field of Search ..... 273/5 B, 5 C, 6, 3 C; 108/144; 297/284; 248/188.2, 188.4

[56] References Cited

UNITED STATES PATENTS

| | | | |
|---|---|---|---|
| 1,860,215 | 5/1932 | Young | 273/3 C |
| 2,542,366 | 2/1951 | Scott | 297/284 |
| 3,288,525 | 11/1966 | Cerf | 297/284 |

FOREIGN PATENTS OR APPLICATIONS

| | | | |
|---|---|---|---|
| 180,442 | 10/1935 | Switzerland | 273/6 |
| 762,304 | 11/1956 | United Kingdom | 297/284 |

*Primary Examiner*—Richard C. Pinkham

*Assistant Examiner*—T. Brown

*Attorney, Agent, or Firm*—Richard M. Rabkin

[57] ABSTRACT

A game board of a table type game, such as for example, a pool table, is provided with a leveling mechanism that includes a support bar mounted beneath the game board and a bed-level slide bracket slidably mounted on the support bar, beneath the game board, for movement to any one of a plurality of positions along the bar. A cooperating bed level guide plate is secured to the underside of the game board directly above and substantially in alignment with the path of travel for a portion of the slide bracket along the support bar. This plate has a longitudinally extending slot formed therein which receives a portion of a bed adjusting mechanism that is mounted on the slide bracket. The adjusting mechanism includes adjustable means cooperating with the guide plate for raising and lowering adjacent portions of the guide board in order to adjust the level thereof.

10 Claims, 6 Drawing Figures

FIG. 3
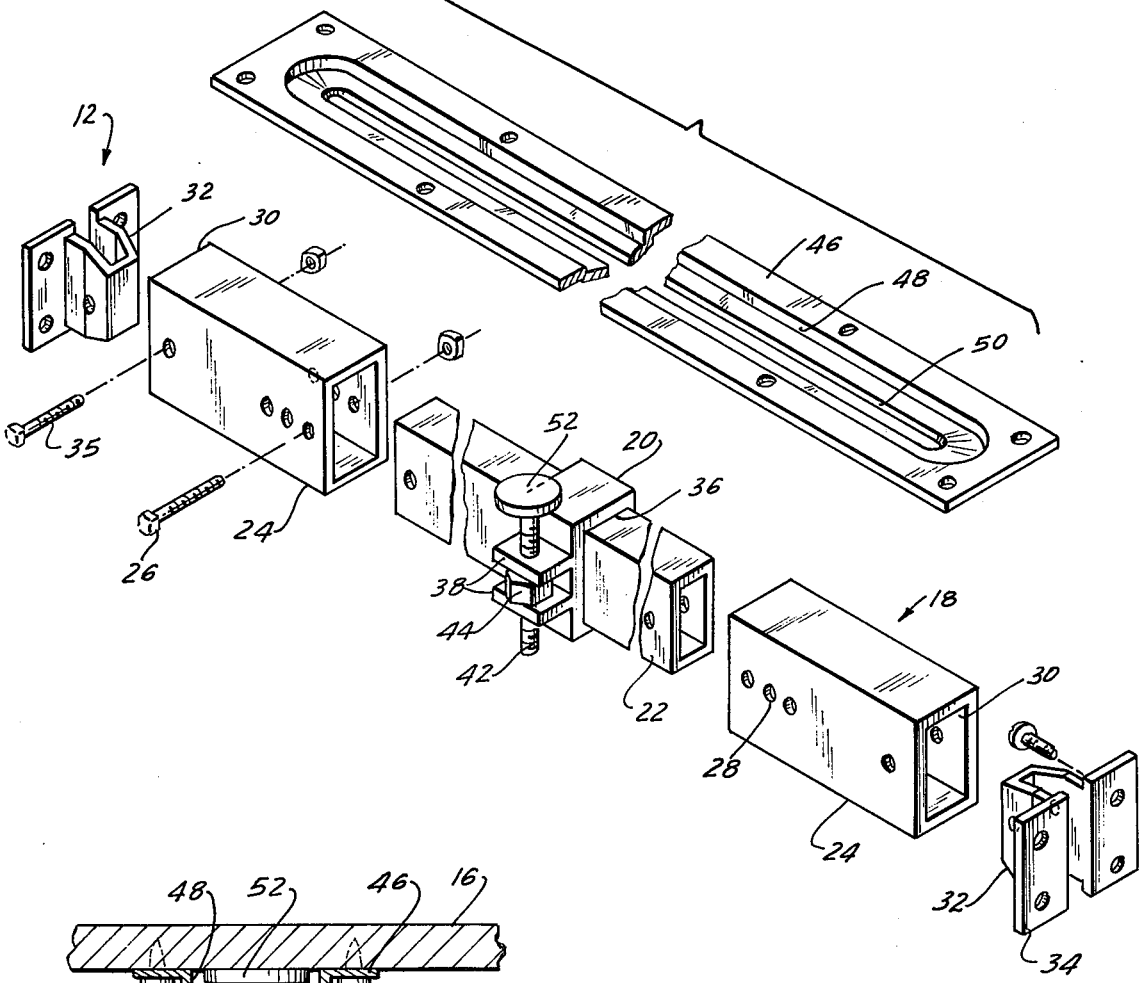
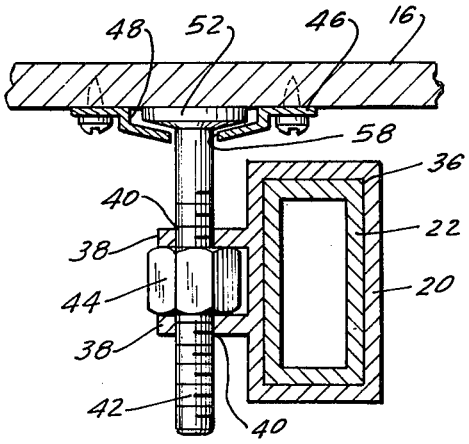
FIG. 4

FIG. 5
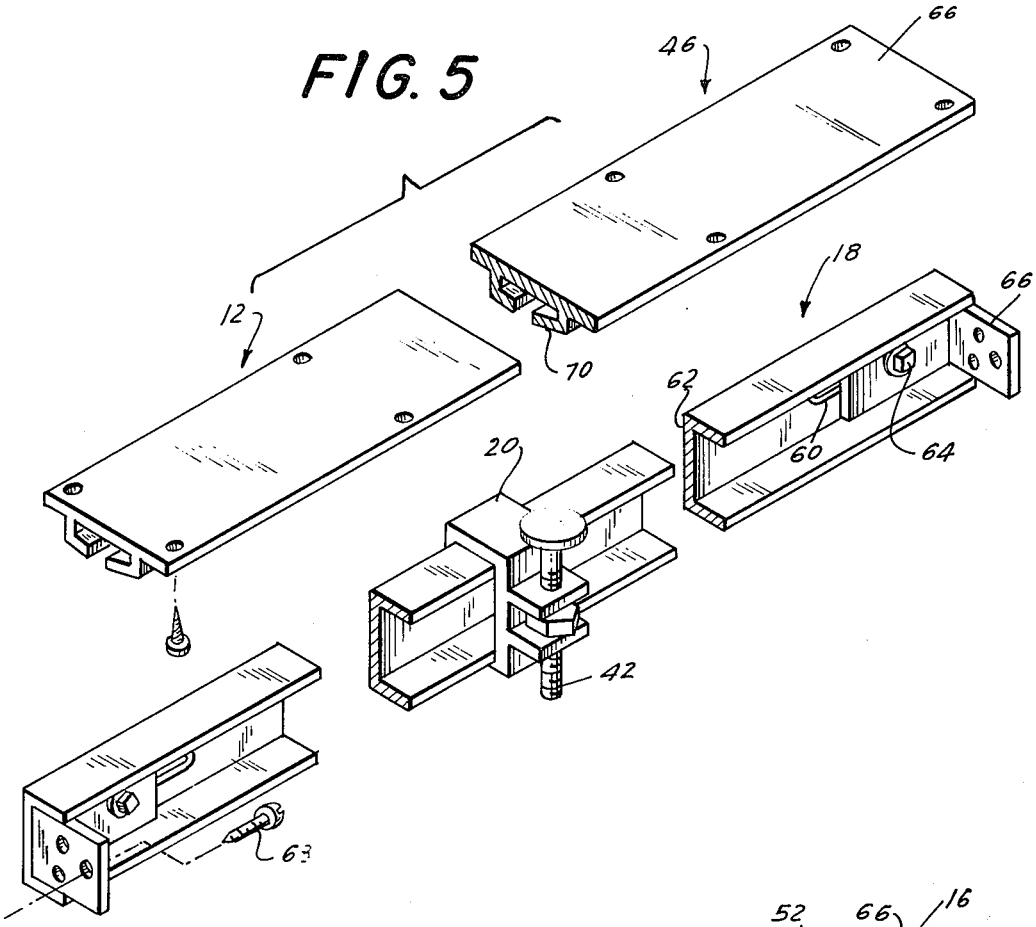
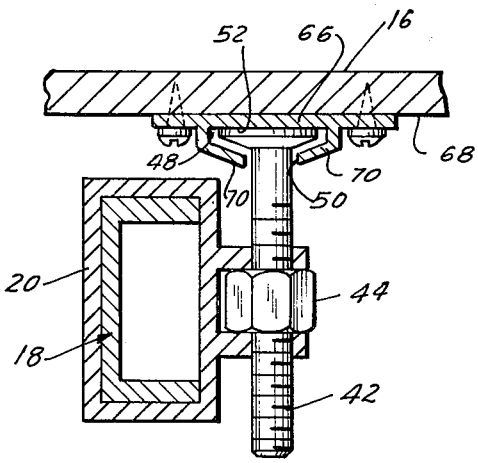
FIG. 6

BED LEVELING MECHANISM

The present invention relates to game boards, and in particular to a mechanism for leveling a game board or play surface.

A variety of types of game boards have table like surfaces, such as for example pool tables or shuffleboard games, which, particularly for the home market, are often made of wood or composition board type materials. In such games it is necessary that the game board be maintained absolutely flat and level in order for the game to be played properly. However, because of the materials of which the game boards are made it sometimes occurs that the boards tend to warp out of shape due to age, temperature, humidity, use and other variable conditions. This warping can take place at any portion of the game board surface, with the result that a generally concave or convex irregularity is formed therein. When this occurs the play surface is not level and the game pieces moved thereon do not travel properly in a true track.

Although a number of different types of leveling mechanisms have been proposed for overcoming the tendency of game boards to warp, such mechanisms have a limited range of use in that they are located in fixed positions beneath the game board. Accordingly they are only effective to compensate for warping of the game board in the area directly above them. However, warping of the game board often occurs in areas between these leveling mechanisms and thus such warping cannot be corrected. As a result, even though leveling mechanisms are provided for the game board, the warping cannot be properly corrected by the user.

Accordingly, it is an object of the present invention to provide a bed-leveling mechanism which can be used to correct warping or other irregularities in a game board substantially wherever the warping occurs.

Another object of the present invention, is to provide a bed-leveling mechanism for a table type game having a game bed or board, which mechanism is adjustable so that the user can change its position to compensate for warping and irregularities of the game board as they occur, from time to time, in different portions of the table.

Another object of the present invention is to provide a bed-leveling mechanism which is adjustable and yet is durable in construction and economical to manufacture.

In accordance with an aspect of the present invention, a bed-leveling mechanism is provided for use in table type games, such as for example pool tables, that have a game board or bed positioned therein. The bed-leveling mechanism includes an elongated rigid support bar mounted in the game below the game board or bed. A slide bracket is slidably mounted on this support bar for relatively free sliding movement to any of a plurality of positions along the bar below the game board. This bracket has a pair of generally horizontally extending spaced flange members located along one side thereof, with the flanges having vertically aligned apertures therein. A threaded adjusting rod is freely rotatably positioned in these apertures in spaced relation to one exterior side of the support bar. The adjusting rod has an enlarged head portion on its upper end which is operatively engaged with the game board. A nut is positioned between the flanges in the slide bracket in threaded engagement with the adjusting rod so that the nut is held against vertical movement by the flanges while rotation of the nut causes longitudinal movement of the rod. A bed-level guide plate is secured to the underside of the game board directly above and in substantial alignment with the path of travel of the slide bracket along the support bar. This guide plate has a longitudinally extending slot formed therein through which the adjusting rod extends, with the enlarged head of the rod received in a channel provided in the guide plate. As a result, rotation of the nut will cause the adjusting rod to move longitudinally with respect to the support bar and game board, while the operative engagement of the enlarged head thereof in the guide plate's channel will move the portion of the game board directly thereabove with the guide rod so that the user can level the surface of the game board. Because of the sliding arrangement of the slide bracket on the support bar, this adjustment can be made wherever the warping irregularity in the game board occurs.

The above, and other objects, features and advantages of this invention will be apparent in the following detailed description of an illustrative embodiment thereof which is to be read in connection with the accompanying drawings, wherein:

FIG. 3 is an enlarged exploded perspective view of a bed-leveling mechanism constructed in accordance with one embodiment of the present invention;

FIG. 4 is a sectional view taken along line 4—4 of FIG. 2;

FIG. 5 is an enlarged exploded perspective view of another embodiment of the present invention; and FIG. 6 is a sectional view, similar to FIG. 4, of the embodiment of the invention illustrated in FIG. 5.

Figure 1:
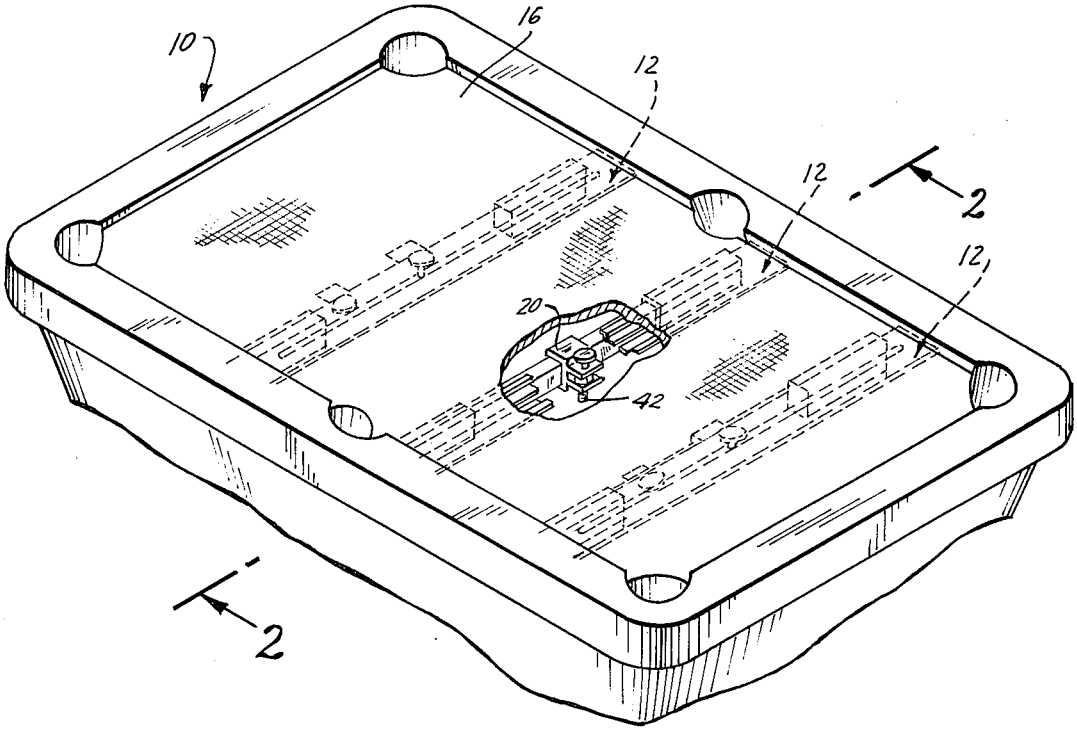
FIG. 1 is a perspective view, with parts broken away, of a pool table incorporating a bed-leveling mechanism in accordance with the present invention.

Referring now to the drawing in detail, and initially to FIG. 1 thereof, a pool table 10 is provided which incorporates therein a bed-leveling mechanism 12 constructed in accordance with the present invention. Although the following description is directed to the pool table illustrated in FIG. 1, it is to be understood that the bed-leveling mechanism 12 can be used with other types of games that require a flat playing surface, such as for example, shuffleboard games, billiard games, simulated hockey games, and the like.

Pool table 10 includes a playing surface 16 which consists of a relatively flat game board. This game board or bed, as mentioned above, may be formed from a sheet of wood or composition material, as would be apparent to those skilled in the art, particularly for relatively inexpensive games, such as would be used in a home. These boards are manufactured so as to be substantially straight and level when the game is new. However, after the game is purchased or delivered, it is possible that the surface of the game board will become warped because of varying atmospheric conditions or other problems. Thus, bed-leveling mechanism 12 is provided to allow the user to restore the game board to its level flat play condition.

In the embodiment of the invention illustrated in FIG. 1, three bed-leveling mechanisms 12 are provided which extend across the width of the game 10. However, it is to be understood that more or less than three of such bed-leveling mechanisms can be provided as desired, and that the mechanisms can be extended along the length of the pool table rather than the width thereof.

Figure 2:
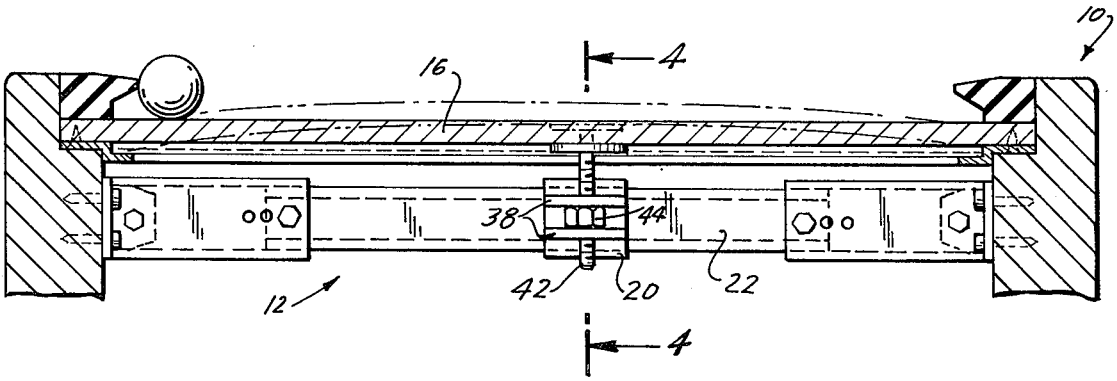
FIG. 2 is a sectional view taken along line 2—2 of FIG. 1.

Referring to FIGS. 2 and 3 of the drawing, the bed-leveling mechanism 12 illustrated therein consists of a support bar arrangement 18 on which a slide bracket 20 is freely slidably mounted. The support bar is provided to accommodate game tables of various widths and includes a central slide portion 22 and a pair of extension portions 24 that are connected to central slide portion 22 in any convenient manner, as for example by the bolts 26. By providing extensions 24 with a plurality of apertures 28, the total length of the leveling mechanism can be adjusted to accommodate the width of the game that the leveling mechanism is used with. In the embodiment of the invention illustrated in FIG. 3, the bar 22 and extensions 24 have a generally rectangular configuration, with the open ends 30 of the extensions receiving bight portions 32 of mounting brackets 34. These mounting brackets are secured to the frame of the table 10 and the support bar is supported on and secured to the brackets by bolts 34 or the like.

Slide bracket 20 is slidably mounted on the central slide portion 22 of the support bar. This slide bracket has a generally rectangular aperture 36 formed therein which is substantially complementary to bar portion 22, but which allows bracket 20 to slide freely on the support bar. Bracket 20 includes a pair of horizontally extending spaced flange members 38 located along one side thereof. These flange members have a pair of vertically aligned openings 40 formed therein which freely and rotatably receive an adjusting rod 42 therein.

A nut 44 is positioned between flange members 38 and is threadably engaged with rod 42. In this manner rotation of nut 44 will cause rod 42 to move vertically, while the nut itself remains relatively stationary.

Game bed 16 is provided on its undersurface with a guide plate 46 which, in the embodiment of the invention illustrated in FIGS. 2–4, consists of a generally elongated rectangular member having a channel or well 48 formed therein that opens upwardly towards bed 16. Well 48 has an elongated slot 50 formed therein which is located in direct vertical alignment with the path of travel of adjusting rod 42 along the support bar 18. As seen in FIG. 4, rod 42 extends upwardly through slot 50 into the well or channel 48. In addition, well 48 receives the enlarged head 52 of adjusting rod 42 thereby to provide an operative connection between the adjusting rod and game bed 16.

By this arrangement, should game bed 16 become warped, or lose its level, at any position along the length of support bar 18, nut 44 is adjusted to allow head 52 of adjusting rod 42 to slide freely in channel 48. This will allow the slide bracket 20 to slide freely along the support bar. The user can then slide the bracket along the bar to the location of the warp in the bed. Preferably the user locates the slide bracket so that head 52 is as close as possible to the center of the warp. Nut 44 is then rotated to move the adjusting rod 42 in the proper direction in order to overcome, and correct, the warp. Thus for example, as illustrated in FIG. 2, if the warp is a convex warp, nut 44 is adjusted so as to move adjusting rod 42 downwardly so that its head 52 pulls down against guide plate 46 and thus pulls the warp down into a substantially level position. On the other hand, should the warp be a convex warp, nut 44 is rotated in the opposite direction to move adjusting rod 42 vertically upward. This drives head 52 of adjusting rod 42 against the lower surface of game bed 16 and urges the bed upwardly to a level position. When the proper level position is achieved the user stops rotating the nut.

Because of the arrangement of adjusting rod 42 with respect to the support bar 22, i.e., because the rod is located outside of, and in spaced relation to the adjusting bar, when stress is applied to the adjusting rod as the bed 16 is leveled, the frictional engagement between the slide bracket 20 and the support rod 22 will be increased. This will maintain the slide bracket in a relatively fixed position. In fact, a slight canting of the slide bracket 20 may take place with respect to support bar 20 which will serve to further insure that the slide bracket does not move. Likewise, the stress in the rod 42, i.e. the pressure on the rod, will hold nut 44 firmly against one of the flanges 38, so as to resist inadvertent rotation of the nut during play of the game.

Another embodiment of bed-leveling mechanism 12 is illustrated in FIGS. 5 and 6. In this embodiment of the invention support bar 18 is provided as a generally channeled shaped member, but this channeled shape member retains the generally rectangular exterior peripheral configuration of the previously described embodiment. Thus, an identical slide bracket 20 may be slidably mounted thereon.

In this embodiment, support bar 18 is provided with longitudinally extending slots 60 in the web 62 thereof, which slots receive nut and bolt assemblies 64 on mounting brackets 66, in order to permit length adjustment of the bar 18. As seen in FIG. 5, brackets 66 are secured in any convenient manner, as for example by screws 63, to the frame of the game.

Also in the embodiment of FIG. 5 a somewhat differently constructed guide plate 46 is provided. In this case the guide plate has a relatively flat metal base 66 which is placed against the bottom surface 68 of game bed 16. This guide plate has, in addition to base 66, a pair of depending flange like elements 70 that define a well or channel 48 therein and a slot 50 therebetween that receives adjusting rod 42. By this arrangement the head 52 of the adjusting rod has a solid metal bearing surface to engage when the rod is adjusted vertically upwardly to correct a convex warp. In operation, the device is otherwise identical to the bed leveling mechanism shown in FIGS. 3 and 4 of the drawing and described above in detail.

Although the drawings primarily illustrate the use of one slide member 20 and associated adjusting rod on each of the support bars, since usually only one such slide adjusting mechanism on each of the support bars would be sufficient to correct any warps or irregularities that may occur in the game bed, it is contemplated that two or more such adjusting mechanisms can be mounted on each of the support bars, as illustrated schematically in FIG. 1.

Accordingly, it is seen that a relatively simply constructed bed level mechanism is provided which can be used to adjust warps or irregularities in the game service substantially wherever they occur. This mechanism is relatively simple to construct and inexpensive to manufacture. Moreover, because of the mounting and adjusting arrangement thereof, the leveling mechanisms can be sold as separate units apart from the game itself. Thus, they need only be purchased by the owner of the game should a warp occur in the table. They need not be provided by the manufacturer with the game as originally sold. The adjustability of the support bar and mounting mechanism further makes the device available for use with a variety of different types of games sold by different manufacturers.

Although illustrative embodiments of the present invention have been described herein with reference to the accompanying drawings, it is to be understood that the invention is not limited to those precise embodiments and that various changes and modifications can be effected therein by those skilled in the art without departing from the scope or spirit of this invention.

What is claimed is:

1. A bed-leveling mechanism for use in table type games having a game board positioned therein, said leveling mechanism comprising a support bar adapted to be mounted beneath said game board, a bed level slide bracket slidably mounted on said bar beneath said game board for movement to any one of a plurality of positions along said bar, a bed level guide plate adapted to be secured to the under surface of said game board above and in substantial alignment with said support bar, said guide plate having a longitudinally extending slot formed therein, and bed adjusting means mounted on said slide bracket for movement therewith and being aligned with and extending into said guide plate through said slot, said bed adjusting means including adjustable means cooperating with said slide bracket for raising and lowering portions of said game board.

2. The bed-leveling mechanism as defined in claim 1 wherein said adjustable means comprises a threaded rod rotatably mounted in said slide bracket and extending through said slot, said rod having an enlarged head portion received in said guide plate, and a nut positioned in said slide bracket and threadably engaged with said rod, said bracket including means for maintaining the nut in a relatively fixed position in said bracket whereby rotation of the nut will cause longitudinal movement of the rod thereby to raise and/or lower the game board.

3. The bed-leveling mechanism as defined in claim 2 wherein said rod is mounted in said bracket exteriorly of one side of said bar whereby stress in said rod, as a result of movement thereof to raise or lower the game board, is transmitted to said slide bracket and operates to maintain the bracket in a fixed position on the support bar.

4. The bed-leveling mechanism as defined in claim 3 wherein said nut maintaining means comprises a pair of spaced flanges extending laterally of said slide bracket and having vertically aligned apertures formed therein receiving said rod, said nut being positioned between said pair of flanges whereby vertical movement of the nut is prevented.

5. The bed-leveling mechanism as defined in claim 4 wherein said guide plate has an upwardly opening channel formed therein for facing said game board, receiving the enlarged head on said rod, and being located in operative engagement with the game board.

6. The bed-leveling mechanism as defined in claim 4 wherein said guide plate includes a flat base adapted to be secured to said game board under surface and a pair of downwardly extending leg members defining said slot and a guide channel therebetween receiving the enlarged head on said rod.

7. A bed-leveling mechanism for use in table type games having a game board positioned therein, said leveling mechanism comprising an elongated rigid support bar adapted to be mounted on said game below the game board, a bed level slide bracket slidably mounted on said support bar for selective movement to any of a plurality of selected positions along said bar, said bracket having a pair of generally horizontally extending spaced flange members located along one side thereof respectively including vertically aligned apertures therein, a threaded adjusting rod freely rotatably received in said apertures in spaced relation to one exterior side of the support bar and having an enlarged head portion on its upper end; a nut positioned between said flanges in threaded engagement with said rod whereby the nut is held against vertical movement by the flanges and rotation of the nut causes longitudinal movement of the rod; and a bed-level guide plate adapted to be secured to the underside of said game board directly above and in alignment with the path of travel of said adjusting rod along said support bar, said guide plate having a longitudinally extending slot formed therein through which said rod extends, with the enlarged head of the rod received in said channel, whereby rotation of said nut will cause adjacent portions of said game board to be raised or lowered.

8. The bed-leveling mechanism as defined in claim 7 wherein said support bar has a generally rectangular peripheral configuration and said support bracket has a rectangular opening therein receiving the support bar, whereby stress in said rod produced upon rotation of said nut to raise or lower the adjacent portions of the game bed tends to cant said bracket slightly thereby to hold the bracket in a fixed position on the support bar.

9. The bed-leveling mechanism as defined in claim 8 wherein said guide plate has an upwardly opening channel formed therein facing said game board, receiving the enlarged head on said rod, and being located in operative engagement with the game board.

10. The bed-leveling mechanism as defined in claim 8 wherein said guide plate includes a flat base secured to said game board and a pair of downwardly extending leg members defining said slot and a guide channel therebetween receiving the enlarged head on said rod.

* * * * *